US006197161B1

(12) United States Patent
Graf et al.

(10) Patent No.: US 6,197,161 B1
(45) Date of Patent: Mar. 6, 2001

(54) PROFILE BAR ASSEMBLY FOR A HEADBOX IN A PAPER-MAKING MACHINE

(75) Inventors: Edwin X. Graf, Menasha; Dale A. Haltinner, Keshena; James A. Eng, Appleton; Frank Stilen, Schiocton, all of WI (US)

(73) Assignee: Voith Sulzer Paper Technology North America, Inc., Appleton, WI (US)

( * ) Notice: Subject to any disclaimer, the term of this patent is extended or adjusted under 35 U.S.C. 154(b) by 0 days.

(21) Appl. No.: 09/336,426

(22) Filed: Jun. 17, 1999

(51) Int. Cl.[7] ..... D21F 1/02
(52) U.S. Cl. ..... 162/344; 162/347
(58) Field of Search ..... 162/344, 347, 162/336

(56) References Cited

U.S. PATENT DOCUMENTS 3,902,961 * 9/1975 Roerig et al. ..... 162/344
4,373,993 * 2/1983 Fujiwara ..... 162/347
4,517,055 * 5/1985 Dove ..... 162/347
4,731,163 * 3/1988 Ilmoniemi ..... 162/344
4,783,241 * 11/1988 Egelhof ..... 162/344

FOREIGN PATENT DOCUMENTS

899586 * 6/1962 (GB) ..... 162/347
1197000 * 7/1970 (GB) ..... 162/344

* cited by examiner

*Primary Examiner*—Karen M. Hastings
(74) *Attorney, Agent, or Firm*—Taylor & Aust, P.C.

(57) ABSTRACT

A headbox for a paper-making machine includes a plurality of side walls and an apron. A nozzle blade is connected to one of the side walls. The nozzle blade and the apron define a discharge nozzle therebetween. A profile bar is rigidly connected to an end of the nozzle blade. A slice lip is rigidly and removably attached to the profile bar and/or nozzle blade. The slice lip and the apron define a discharge outlet therebetween.

14 Claims, 3 Drawing Sheets

PROFILE BAR ASSEMBLY FOR A HEADBOX IN A PAPER-MAKING MACHINE

BACKGROUND OF THE INVENTION

1. Field of the Invention

The present invention relates to paper-making machines, and, more particularly to a profile bar assembly used in a headbox of a paper-making machine.

2. Description of the Related Art

A paper-making machine is used to make a fiber web, such as a paper web. A headbox at the wet end of the paper-making machine receives a fiber suspension and discharges the fiber suspension with a controlled cross-sectional profile onto a wire in a forming section adjacent to the discharge outlet of the headbox. The headbox typically includes a nozzle plate which together with the bottom apron defines a discharge nozzle terminating at the discharge outlet.

A headbox as described above typically includes a relatively complex profile bar assembly having many pieces, moving parts, seals, etc. A slice lip with a single working edge extending across the width of the discharge outlet is slidably disposed within corresponding clamping structures in the profile bar assembly. Adjustment spindles spaced across the width of the slice lip typically engage the back of the slice lip opposite the single working edge. Although such a profile bar assembly provides adequate and effective profiling and sealing at the discharge outlet, it can be relatively expensive. An example of such a profile bar assembly is manufactured and sold by the assignee of the present invention under the name "CONSTALIP-C".

What is needed in the art is a profile bar assembly which is simple and inexpensive, provides retrofit capabilities to existing headboxes, and reduces replacement costs.

SUMMARY OF THE INVENTION

The present invention provides a headbox for a paper-making machine, including a profile bar assembly with a profile bar which is rigidly attached to a nozzle blade and includes a plurality of vertical cuts providing local adjustment. A slice lip is rigidly attached to the nozzle blade and/or profile bar in one of two positions such that a selected edge defines a discharge outlet.

The invention comprises, in one form thereof, a headbox for a paper-making machine including a plurality of side walls and an apron. A nozzle blade is connected to one of the side walls. The nozzle blade and the apron define a discharge nozzle therebetween. A profile bar is rigidly connected to an end of the nozzle blade. A slice lip is rigidly and removably attached to the profile bar and/or nozzle blade. The slice lip and the apron define a discharge outlet therebetween.

An advantage of the present invention is that the profile bar and slice lip are provided as separate but removably attachable pieces, thereby allowing local flexing and adjustment of the profile bar while preventing deleterious effects on the slice lip.

Another advantage is that the slice lip includes two working edges, with the slice lip being attached in one of two different positions so that a selected working edge defines the discharge outlet with the apron.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
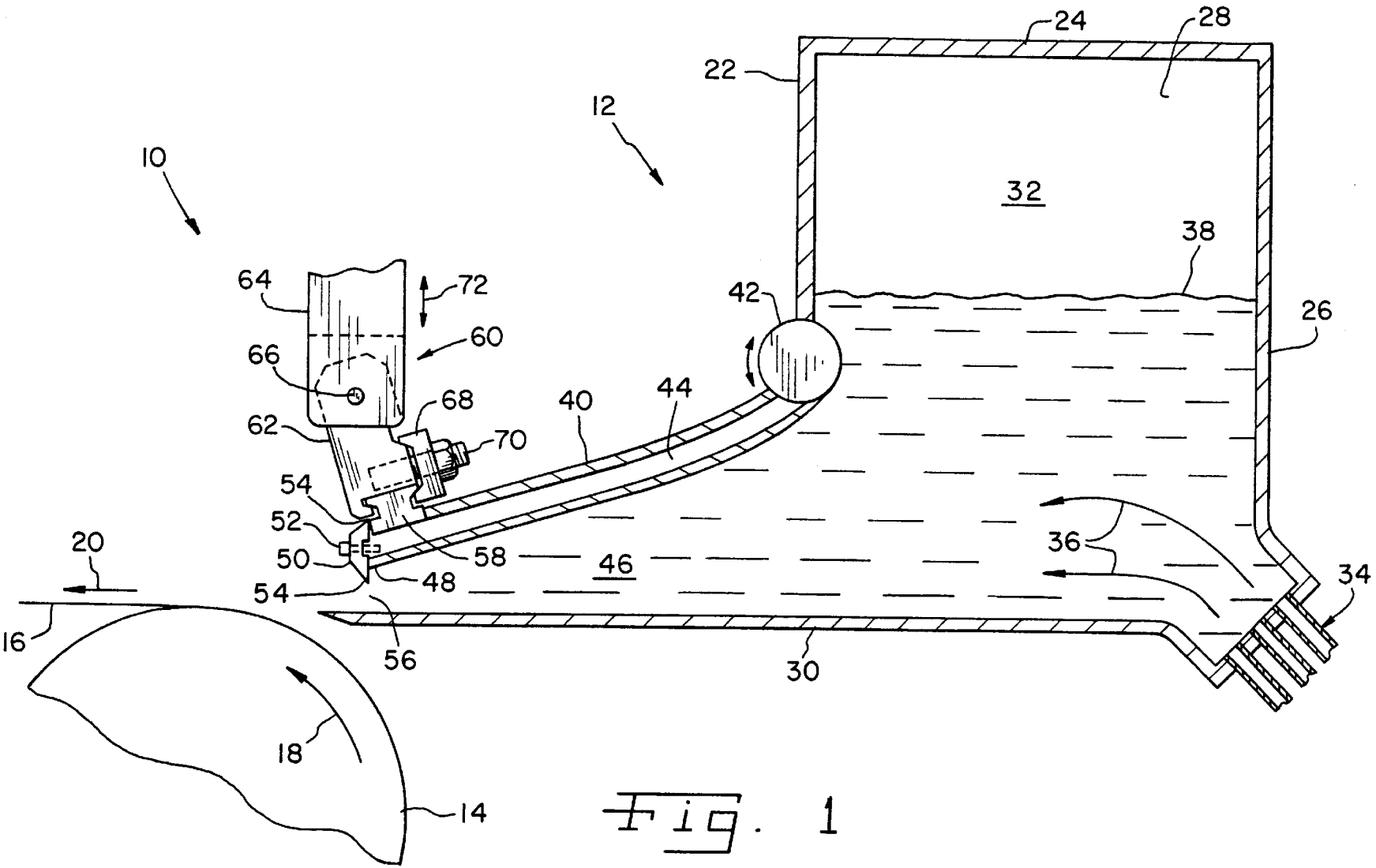
FIG. 1 is a schematic, side view of an embodiment of a paper-making machine, including a headbox with an embodiment of a profile bar assembly of the present invention.

Referring now to the drawings and particularly to FIG. 1, there is shown an embodiment of a portion of a paper-making machine 10 including an embodiment of a headbox 12 of the present invention. Paper-making machine 10 also includes a plurality of rolls, such as a breast roll 14 carrying a wire 16. Breast roll 14 rotates in the direction indicated by arrow 18, and wire 16 moves in the direction indicated by arrow 20.

Headbox 12 includes a plurality of side walls, such as a front wall 22, top wall 24, back wall 26 and opposing end walls (one of which is shown and referenced 28). An apron 30 defines a bottom wall of headbox 12 and is connected to each of side walls 22-28. Apron 30 and side walls 22–28 define a chamber 32 within headbox 12. A tube bundle 34 supplies a prepared fiber suspension to chamber 32 within headbox 12. The fiber suspension flows through headbox 12 in a direction indicated generally by arrows 36. An air cushion (not numbered) within chamber 32 is disposed above a liquid level 38 of the fiber suspension within headbox 12. The air cushion helps to control the pressure of the fiber suspension within headbox 12 and also helps to reduce pressure fluctuations of the fiber suspension.

A nozzle blade 40 is connected to front wall 22 and extends across the working width of headbox 12. Nozzle blade 40 is pivotally connected to front wall 22, as indicated schematically at joint 42. A pair of edge seals (one of which is shown and referenced 44) are positioned at each side edge of nozzle blade 40 and seal with a corresponding end wall (such as end wall 28 during pivotal movement of nozzle blade 40. Nozzle blade 40 and apron 30 define a discharge nozzle 46 therebetween through which the fiber suspension flows. The fiber suspension flow velocity increases as the cross-sectional area of discharge nozzle 46 decreases. Discharge nozzle 46 terminates adjacent a discharge end 48 of nozzle blade 40.

A slice lip 50 is rigidly and removably attached to nozzle blade 40 using a plurality of bolts 52 spaced across the working width of slice lip 50. Slice lip 50 includes a plurality of through holes and nozzle blade 40 includes a plurality of threaded openings (each shown by phantom lines but not numbered for purposes of clarity) through which respective bolts 52 extend for attaching slice lip 50 to nozzle blade 40. Slice lip 50 includes two working edges 54 extending across the working width thereof. Slice lip 50 may be attached to nozzle blade 40 in one of two selected positions such that a selected one of working edges 54 is disposed adjacent to and in communication with discharge nozzle 46. A selected working edge 54 and apron 30 thus define a discharge outlet 56 of headbox 12. The fiber suspension is jetted onto wire 16 from discharge outlet 56 with a controlled cross-sectional profile to define a paper web which is produced by paper making machine 10. Slice lip 50 and nozzle blade 40 may include abutting surfaces with a keying feature (shown but not numbered) to provide proper and accurate attachment positioning of slice lip 50 relative to nozzle blade 40.

A profile bar 58 is rigidly attached to discharge end 48 of nozzle blade 40. In the embodiment shown, nozzle blade 40 includes a notch therein in which profile bar 58 is located. Profile bar 58 may be rigidly attached to nozzle blade 40 using any attachment method, such as welding, bolting, etc. Profile bar 58 has a cross-sectional profile as shown which is substantially continuous across the working width of nozzle blade 40. It is to be understood that the terms "profile bar" and "mounting bar" are synonymous as used herein.

An adjustment device including a plurality of adjustment mechanisms 60 provides local adjustment of discharge outlet 56 across the working width of slice lip 50. Adjustment mechanisms 60, one of which is shown, are spaced at predetermined distances relative to each other across the working width of slice lip 50. Each adjustment mechanism 60 includes a profile block in the form of a clamp 62 which is pivotally connected to a thrust member 64 at a pivot pin 66. Clamp 62 is clamped to profile bar 58 using a clamping plate 68 and a bolt 70. Thrust member 64 is controllably movable in longitudinal directions indicated by arrow 72 and causes corresponding movement of clamp 62 generally toward and away from discharge outlet 56. Thus, movement of thrust member 64 effects local profile adjustment of discharge outlet 56.

Figure 2:
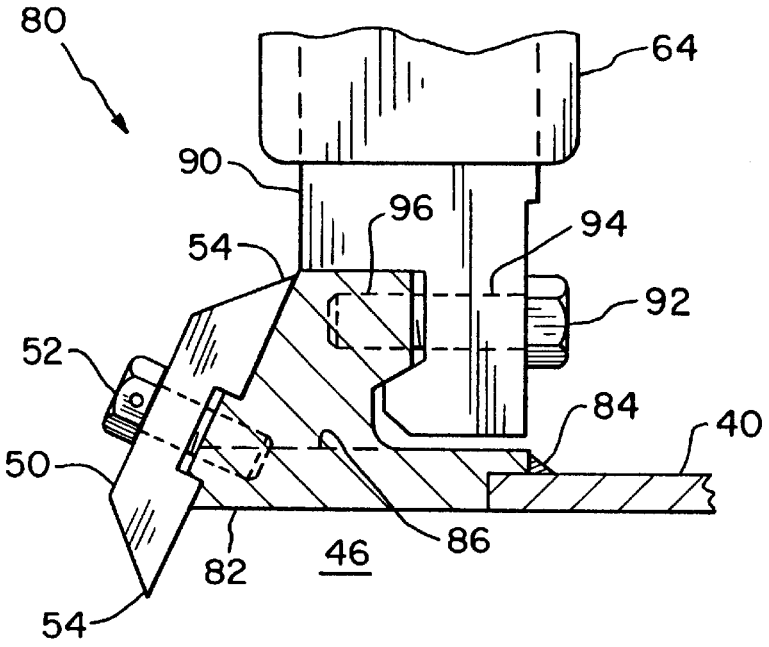
FIG. 2 is a fragmentary, side view of another embodiment of a profile bar assembly of the present invention.
Figure 4:
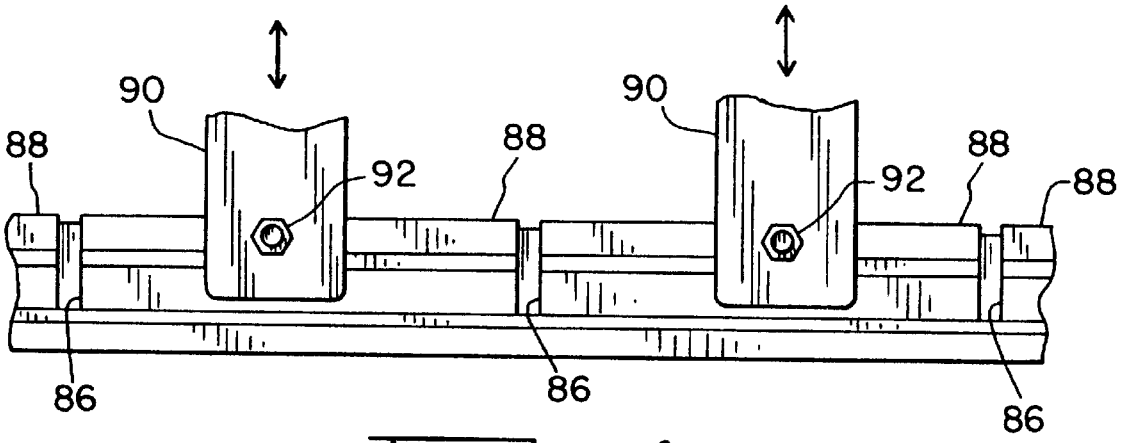
FIG. 4 is a fragmentary, plan view of the profile bar assembly shown in FIG. 2 as viewed from the right side of FIG. 2.

FIGS. 2 and 4 illustrate another embodiment of a profile bar assembly 80 of the present invention which may be used in a headbox such as headbox 12 shown in FIG. 1. Profile bar assembly 80 includes a profile bar 82 which is rigidly attached to nozzle blade 40 using a weld 84. Profile bar 82 includes a plurality of cuts 86 which are positioned on a side of profile bar 82 generally opposite from discharge nozzle 46, and extend generally orthogonal to discharge nozzle 46. Cuts 86 are spaced apart across the working width of profile bar 82 at predetermined distances to define segments 88. Cuts 86 allow easier local profile adjustment of profile bar 82. A profile block 90 is connected to each respective segment 88 approximately equidistantly between adjacent cuts 86. Each profile block 90 may be attached to a corresponding segment 88 using any desired attachment method, depending upon the specific application. In the embodiment shown, each profile block 90 is attached to a corresponding segment 88 using a bolt 92 which extends through a corresponding through hole 94 and is threadingly engaged with a threaded opening 96 in a respective segment 88. Each profile block 90 is pivotally attached to a thrust member 64 through a suitable pivotal connection (not shown).

Figure 3:
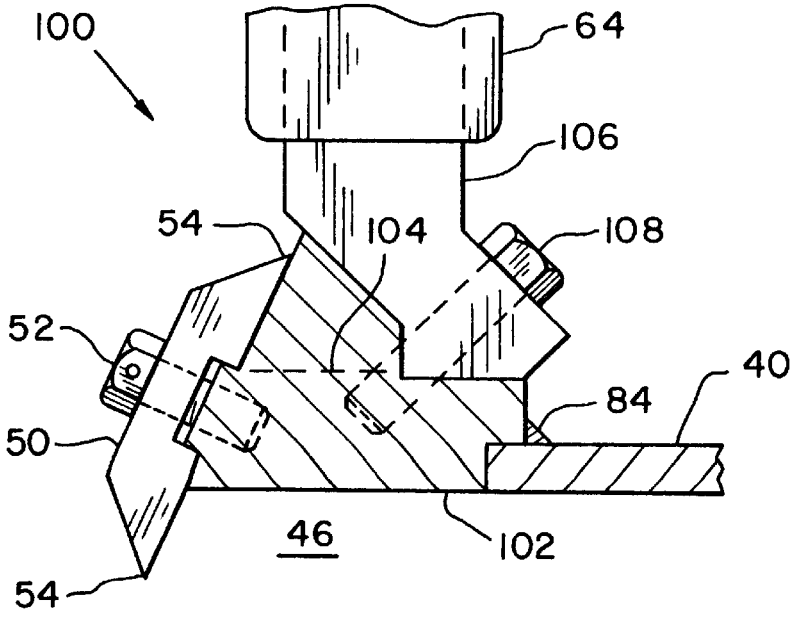
FIG. 3 is a fragmentary, side view of yet another embodiment of a profile bar assembly of the present invention.

FIG. 3 illustrates another embodiment of a profile bar assembly 100 of the present invention. Profile bar assembly 100 also includes a profile bar 102 having a plurality of cuts 104 which are spaced apart across the working width of profile bar 102 and extend generally orthogonal to discharge nozzle 46. Cuts 104 define respective segments (not numbered) therebetween. Each segment is connected with a corresponding profile block 106 in a suitable manner, such as by using a bolt 108. Each profile block 106 is pivotally connected to a thrust member 64 for providing local cross-profile adjustment of working edge 54 of slice lip 50.

In the embodiments of profile bar assemblies 80 and 100 shown in FIGS. 2–4, profile bars 82 and 102 each include a plurality of segments which are connected in a one-to-one relationship with corresponding profile blocks 90 and 106. However, it is to be appreciated that the number of profile blocks 90 or 106 used to provide local cross-profile adjustment of slice lip 50 may vary dependent upon the specific application. For example, profile blocks 90 and 106 may be connected with every second or third segment of a corresponding profile bar 82 or 102.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A headbox for a paper-making machine, comprising:

a plurality of side walls and an apron;

a nozzle blade connected to one of said side walls, said nozzle blade and said apron defining a discharge nozzle therebetween;

mounting bar having a first side and a second side, said second side being opposite said first side, said first side being rigidly connected to an end of said nozzle blade;

a slice lip rigidly and removably attached to said second side of said mounting bar, said slice lip and said apron defining a discharge outlet therebetween.

2. The headbox of claim 1, wherein said slice lip includes a plurality of through-holes and at least one of said mounting bar and said nozzle blade includes a plurality of threaded openings, and further comprising a plurality of threaded fasteners, each said fastener extending through a corresponding said through hole and threadingly engaged with a corresponding said threaded opening.

3. The headbox of claim 2, wherein said mounting bar includes said threaded openings.

4. The headbox of claim 2, wherein said nozzle blade includes said threaded openings.

5. The headbox of claim 1, wherein said slice lip includes two edges, said slice lip being selectively attached in one of two positions, whereby a selected one of said edges defines said discharge outlet.

6. The headbox of claim 1, wherein said mounting bar is metallurgically bonded to said nozzle blade.

7. The headbox of claim 6, wherein said mounting bar is welded to said nozzle blade.

8. The headbox of claim 1, further comprising a plurality of profile blocks connected to said mounting bar.

9. The headbox of claim 8, wherein each said profile block is connected to said mounting bar via a bolted connection.

10. The headbox of claim 8, wherein said mounting bar includes a plurality of cuts positioned on a side generally opposite from said discharge nozzle and extending generally orthogonal to said discharge nozzle.

11. The headbox of claim 10, wherein one of said cuts is located between each adjacent pair of said profile blocks.

12. A headbox for a paper-making machine, comprising:

a plurality of side walls and an apron;

a nozzle blade connected to one of said side walls, said nozzle blade and said apron defining a discharge nozzle therebetween;

a mounting bar rigidly connected to an end of said nozzle blade;

a slice lip rigidly and removably attached to said mounting bar and opposite said nozzle blade, said slice lip and said apron defining a discharge outlet therebetween;

a plurality of profile blocks connected to said mounting bar; and at least one thrust member pivotally connected to a corresponding said profile block, said at least one thrust member being configured for moving said corresponding profile block in a direction generally toward and away from said apron, thereby providing local adjustment of said mounting bar and said discharge outlet.

13. A mounting bar assembly in a headbox in a papermaking machine, comprising:

a mounting bar having a longitudinal extension and a plurality of cuts extending generally orthogonal to said longitudinal extension; and a slice lip rigidly and removably attached to said mounting bar via a plurality of bolted connections, said slice lip including two edges and being selectively attached to said mounting bar in one of two positions, whereby a selected one of said edges extends from said mounting bar on a side generally opposite from said plurality of cuts for defining a discharge outlet.

14. The mounting bar assembly of claim 13, further comprising a plurality of profile blocks connected to said mounting bar.

* * * * *